US009065193B2

(12) United States Patent
Urban

(10) Patent No.: US 9,065,193 B2
(45) Date of Patent: Jun. 23, 2015

(54) VARIABLE PLUG OF A CONNECTOR

(71) Applicant: WEETECH GmbH, Wertheim (DE)

(72) Inventor: Eberhard Urban, Wallduern (DE)

(73) Assignee: WEETECH GMBH, Wertheim (DE)

( * ) Notice: Subject to any disclaimer, the term of this patent is extended or adjusted under 35 U.S.C. 154(b) by 126 days.

(21) Appl. No.: 13/895,874

(22) Filed: May 16, 2013

(65) Prior Publication Data

US 2013/0316561 A1 Nov. 28, 2013

(30) Foreign Application Priority Data

May 25, 2012 (DE) ..... 10 2012 104 549

(51) Int. Cl.

| | |
|---|---|
| ***H01R 4/50*** | (2006.01) |
| ***H01R 13/02*** | (2006.01) |
| ***H01R 13/03*** | (2006.01) |
| ***H01R 13/514*** | (2006.01) |
| ***H01R 13/58*** | (2006.01) |
| ***H01R 13/62*** | (2006.01) |
| *H01R 13/508* | (2006.01) |

(52) U.S. Cl.

CPC ..... *H01R 13/02* (2013.01); *H01R 13/035* (2013.01); *H01R 13/508* (2013.01); *H01R 13/514* (2013.01); *H01R 13/5816* (2013.01); *H01R 13/62* (2013.01)

(58) Field of Classification Search

CPC .. H01R 13/639; H01R 13/627; H01R 13/506; H01R 13/6271; H01R 13/436; H01R 13/514; H01R 9/2408; H01R 9/26; H01R 13/518; H01R 12/716; H01R 31/02

USPC ..... 439/76.1, 717, 701

See application file for complete search history.

(56) References Cited

U.S. PATENT DOCUMENTS

| | | | | |
|---|---|---|---|---|
| 5,288,251 | A * | 2/1994 | Sumida | 439/701 |
| 5,679,008 | A * | 10/1997 | Takahashi et al. | 439/76.1 |
| 5,890,933 | A | 4/1999 | Okabe | |
| 6,739,910 | B1 | 5/2004 | Wu | |
| 6,884,117 | B2 * | 4/2005 | Korsunsky et al. | 439/607.11 |
| 6,893,270 | B2 * | 5/2005 | Sercu | 439/76.1 |
| 7,494,384 | B2 * | 2/2009 | Friedhof | 439/701 |
| 7,651,375 | B2 * | 1/2010 | Zhu et al. | 439/607.41 |
| 7,654,831 | B1 * | 2/2010 | Wu | 439/76.1 |
| 7,892,045 | B2 | 2/2011 | Ratzlaff | |
| 8,002,575 | B2 * | 8/2011 | Li et al. | 439/465 |
| 8,303,314 | B2 * | 11/2012 | Wu | 439/76.1 |
| 2010/0015851 | A1 | 1/2010 | Wu | |
| 2011/0250778 | A1 | 10/2011 | Wu | |
| 2011/0256776 | A1 | 10/2011 | Reed | |

FOREIGN PATENT DOCUMENTS

| | | | |
|---|---|---|---|
| DE | 41 14 921 | A1 | 11/1992 |
| DE | 20 2007 018 306 | U1 | 4/2008 |
| EP | 0 845 837 | A1 | 6/1998 |
| EP | 1 538 716 | A2 | 6/2005 |
| WO | 03/100916 | A1 | 12/2003 |

OTHER PUBLICATIONS

European Search Report Dated Sep. 10, 2013.

* cited by examiner

*Primary Examiner* — Xuong Chung Trans

(74) *Attorney, Agent, or Firm* — Norris McLaughlin & Marcus P.A.

(57) ABSTRACT

A variable plug of a connector has a modular construction and includes a base module with cable connection and plug contacts. Depending on the desired total number of contacts of the plug, one or more add-on modules having additional plug contacts can be mechanically and electrically connected with the base module.

11 Claims, 4 Drawing Sheets

VARIABLE PLUG OF A CONNECTOR

BACKGROUND OF THE INVENTION

The present invention relates to a plug of a connector which is designed to have a variable number of plug contacts.

Increasingly, new technologies such as bus systems, fiber optic systems and more complex plug systems require innovative test strategies for electrical and non-electrical tests. The demand for higher throughput in mass production has to be weighed against small batch sizes and the demand for short set-up times.

The test specification may require a simple check of the connection, but may also require a high-voltage test to detect insulation faults. Furthermore, a test of electronic and electromechanical components and assemblies in wire harnesses may be requested.

The tests use plug-in connectors. The number of plug contacts must correspond to the test plug. This means that a large number of different connectors must be provided. For this reason, modular plug-in connectors exist which produce a plug adapted to the requirement through expansion of basic elements. These are laboriously assembled by screw connections or must be disassembled in a complex process when parts subject to wear must be replaced. This in turn results in financial and logistical expenditures.

It would therefore be desirable and advantageous to obviate prior art shortcomings and to provide an improved plug of a connector that can be assembled in a less expensive and less complex manner.

SUMMARY OF THE INVENTION

According to an aspect of the invention, a variable plug of a connector has a modularly constructed base module having a cable connection and first plug contacts. One or more add-on modules have second plug contacts and are constructed to be mechanically and electrically connected with the base module, wherein a total number of the add-on modules depends on a desired total number of contacts.

The variable plug of a plug-in connector according to the invention has a modular design and is composed of a base module with a cable connection and plug contacts.

Depending on the desired total number of contacts, one or more add-on modules provided with plug contacts may be connected to the base module. The base module is preferably composed of a base shell and a cover.

The cable relief is inserted in the base shell, and a printed circuit board carrying the plug contacts is inserted between the base shell and the cover and secured when the base shell and the cover are joined.

The cover of the base module has detent hooks which enter in corresponding recesses of the base shell arranged transversely to the longitudinal extent of the base shell when the base shell and the cover are joined.

Pin-shaped locking devices, which extend in the longitudinal direction and are open to the outside and engage behind the detent hooks when inserted into recess channels of the base shell connecting the aforementioned recesses, are provided for positive locking of the cover, thereby locking the cover.

A corresponding retaining spring having a projection is arranged in the recess channels, in which the latches are inserted, so that the projection engages into a correspondingly shaped portion disposed on the locking device in the inserted position of the locking device and fixes the position. A notch is introduced into the end of the locking device facing the insertion side of the locking device, whereas an indentation is introduced into the outer contour of the base shell at the beginning of the recess channel in which the locking device is inserted. Both measures are designed to facilitate handling when removing the locking device.

To increase the number of contacts of the plug, add-on modules are provided that can be connected with the basic module. The add-on modules are composed of a middle shell which, as also the cover, is provided on the side facing the base side of the shell with detent hooks for connection with the base shell during assembly, and on the opposite side, as also the base shell, is provided with recesses and recess channels. The base shell is joined with one or more middle shells in the same manner as described above in conjunction with joining of the base shell and the cover by locking devices. Lastly, the cover is attached to the outermost middle shell in the same manner.

Preferably, a mandrel is provided on the base shell and on each middle shell transversely to their longitudinal extent wherein the mandrel engages in an opening provided in the printed circuit board for receiving and centering the printed circuit board. The printed circuit board is mounted so as to allow a predetermined clearance between the printed circuit board and the base shell or middle shell for compensating a vertical and horizontal tolerance of the contacts.

Each middle shell has a printed circuit board carrying the contacts as well as an opening for the passage of the cable wires to the contacts of the middle shells.

Preferably, the base shell, the middle shells and the cover are made of plastic.

The retaining springs securing the locking devices are preferably incorporated in the geometry and material of the base shell and of the middle shells, i.e. they are made of the same material as each of the modules.

The outer contour of the housing parts base shell, middle shells and cover may be provided with a rectangular spring for absorbing tensile forces of a completely inserted system, wherein the corresponding groove may be arranged in a rail connected to the mating connector.

On the outer contour of the housing parts base shell, middle shells and cover, a handle-shaped extension may be provided on the cable entry side for handling of the connector.

Advantageously, the base shell has in the region of the printed-circuit-board receptacle a recess configured to receive an ID chip located on the printed circuit board for self-identification.

A commercially available printed-circuit-board connector of the type Card Edge may be used as a mating connector of the circuit connector.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
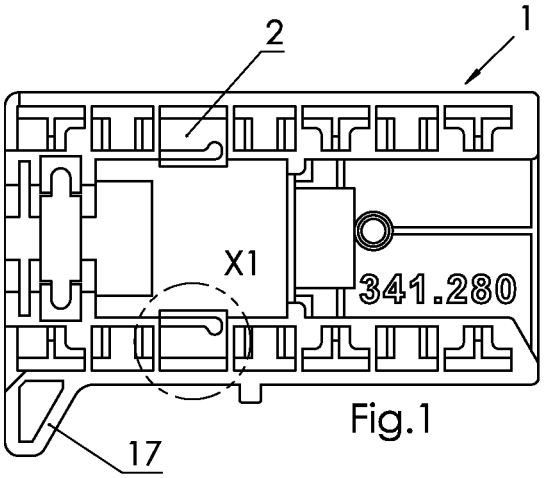
FIG. 1: shows the base shell of a connector according to the present invention from the open side.
Figure 2:
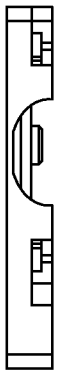
FIG. 2: shows the base shell from the cable-entry side

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a base shell with four recesses 2 disposed on the upper and lower inner side, in which the detent hooks 7 of the middle shell 9 (FIG. 6) or of the cover 10 (FIG. 9) can engage transversely of the longitudinal extension of the shell during assembly. The retaining springs 5 (FIGS. 3 and 4) with the engaging projections 11 (FIG. 3) that engage in the inserted state of the locking device 4 in the recess 6 (FIG. 12) on the locking device 4 and secure these, are located in the recess channel 3 which extends in the longitudinal direction of the shell and into which the pin-shaped locking devices 4 (FIGS. 11 and 12) are inserted in the direction A for positively securing the middle shell 9 (FIG. 6) and the cover 10 (FIG. 9), respectively.

Figure 5:
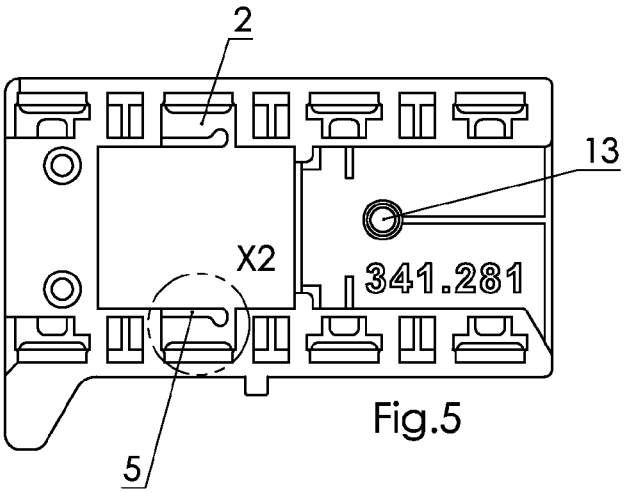
FIG. 5 shows the middle shell of a connector according to the present invention from the outer side.
Figure 6:
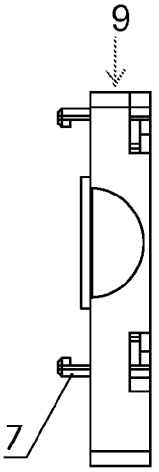
FIG. 6 shows the middle shell from the cable-entry side FIG. 7 the detail of FIG. 5.
Figure 8:
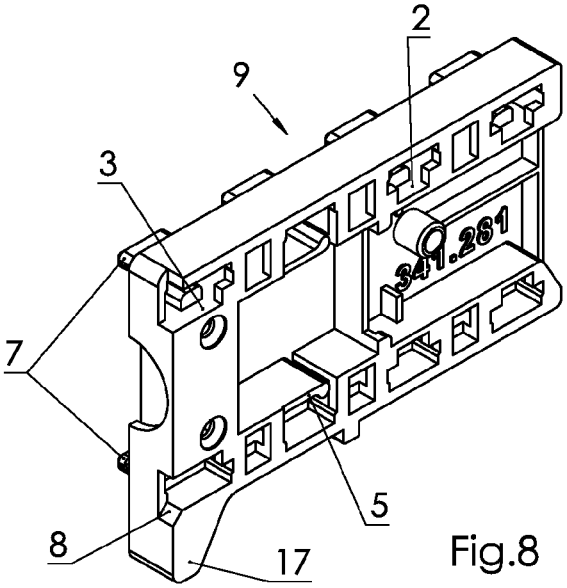
FIG. 8 shows a perspective view of the middle shell.
Figure 9:
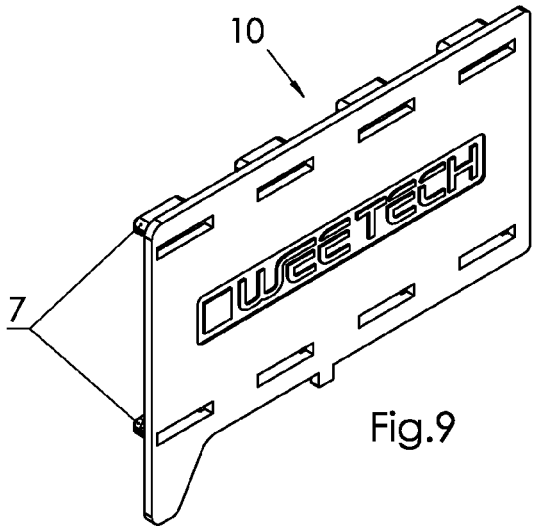
FIG. 9 shows a perspective view of the cover of a connector according to the present invention.

FIGS. 6, 8 and 9 clearly show the detent hooks 7 disposed on the middle shell 9 and the cover 10, respectively, while FIGS. 5 and 8 clearly show the recesses 2 in the transverse direction of the middle shell and the recess channels 3 in the longitudinal direction of the middle shell 9.

Figure 3:
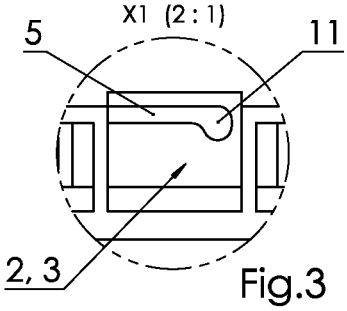
FIG. 3 shows the detail of FIG. 1.
Figure 7:
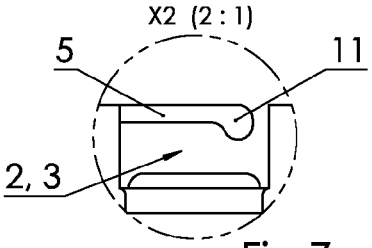

FIGS. 3 and 7 show each the retaining spring 5 with its projection 11 arranged in the recess 2, 3.

Figure 10:
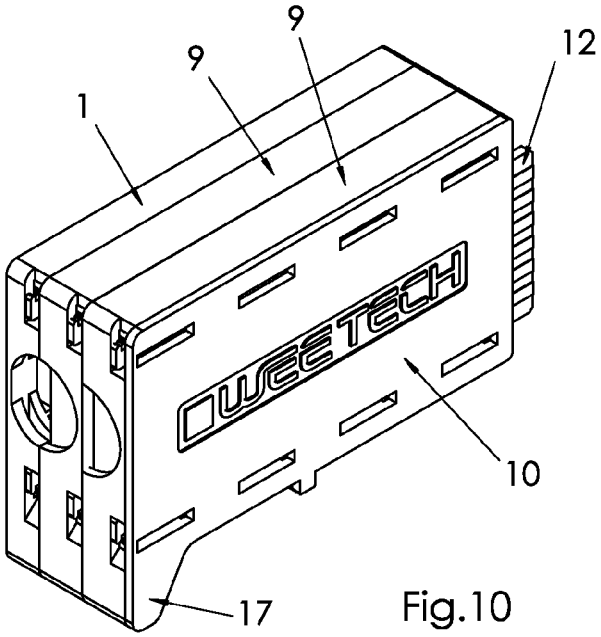
FIG. 10 shows a connector system according to the present invention with a base shell and two middle shells.

FIG. 10 shows a connector system with a base shell 1 and two middle shells 9. The plug contacts of the printed circuit board are labeled as 12.

Figure 4:
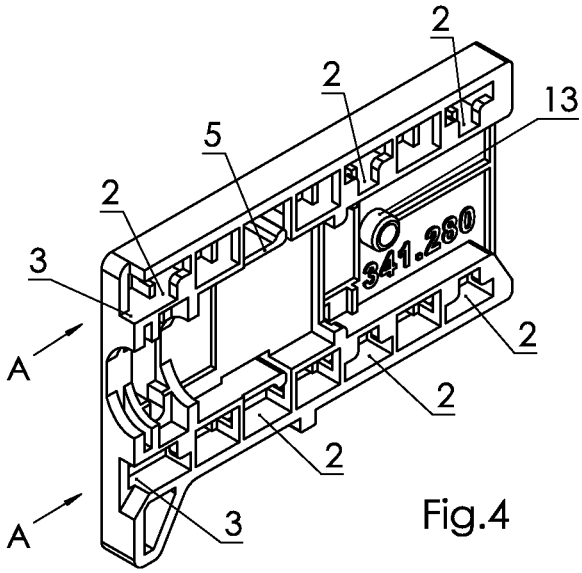
FIG. 4 shows a perspective view of the base shell.

FIGS. 4 and 5 show the mandrel 13 on which the printed circuit board 14 (FIG. 11) carrying the plug contacts 12 is affixed by way of a borehole in the printed circuit board.

Figure 11:
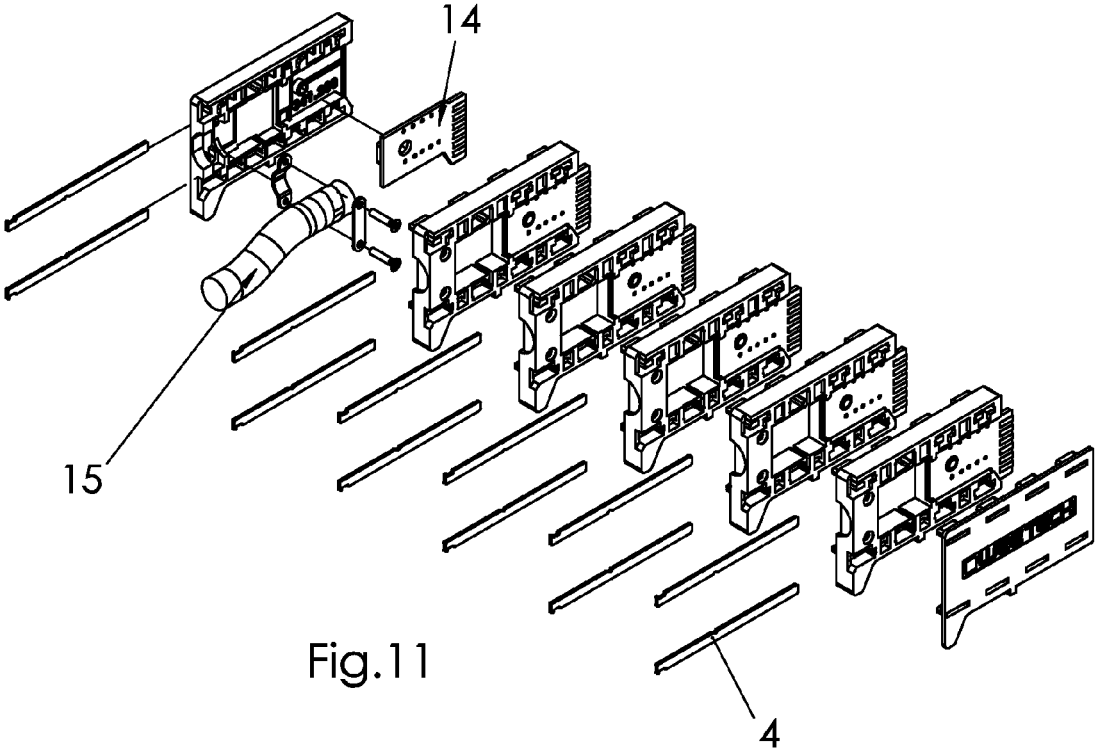
FIG. 11 shows an exploded view of a connector system with five middle shells.

FIG. 11 also shows for the cable relief 15 which is secured in the plug when the base shell 1 and the middle shell 9 and the cover 10, respectively, are joined.

Figure 12:
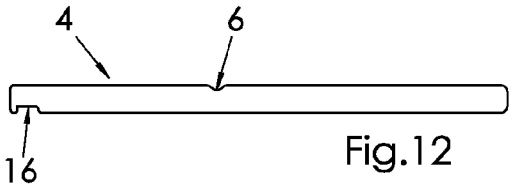
FIG. 12 shows a pin-shaped locking device.

FIG. 12 shows a pin-shaped locking device 4 with the recess 6, in which the retaining spring 5 engages, and with the notch 16 to facilitate removal of the locking device 4 from the recess channel 3.

A recess 8 (FIG. 8) located on the side of the shell recess channels 3 extending in the longitudinal direction of the shells and facing the cable is provided in the base shell and in each of the middle shells, which also serves to facilitate removal of the locking device.

A handle-shaped extension (17) on all housing parts (1, 9, 10) improves the handling of the plug.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A variable plug of a connector, comprising a modularly constructed base module having a cable connection and first plug contacts, and one or more add-on modules having second plug contacts, wherein the add-on modules are constructed to be mechanically and electrically connected with the base module, and wherein a total number of the add-on modules depends on a desired total number of contacts;

wherein the base module comprises a base shell and a cover, a cable relief inserted in the base shell, and a printed circuit board carrying the first plug contacts and inserted between the base shell and the cover, wherein the printed circuit board is secured in place when the base shell and the cover are joined; and wherein the cover of the base module comprises detent hooks and the base shell comprises recesses and outwardly open recess channels, with the detent hooks positively locking in the recesses when the base shell and the cover are joined, wherein pin-shaped locking devices are inserted into the outwardly open recess channels that connect the recesses of the base shell so as to positively lock the cover, with the pin-shaped locking devices engaging behind the detent hooks and positively locking the cover.

2. The plug according to claim 1, wherein a retaining spring having a projection is arranged in each of the recess channels, in which the locking devices are inserted, so that a projection in the inserted position of the locking device latches in a corresponding recess on the locking device and secures the locking device in place.

3. The plug according to claim 1, wherein a cable-side end of the locking device comprises a notch, and an outer contour of each module comprises a recess disposed at a beginning of a recess channel into which a corresponding locking device is inserted, which facilitate handling when the locking device is removed.

4. The plug according to claim 1, wherein each add-on module configured to increase the number of contacts comprises a middle shell, wherein the cover and each add-on module comprise detent hooks on a side facing the base shell in an assembled state, and wherein the base shell and each add-on module comprise on an opposite side facing the cover recesses and recess channels, wherein the base shell, the one or more middle shells and the cover are joined by way of pin-shaped locking devices inserted into the recess channels that connect the recesses and engaging behind the detent hooks.

5. The plug according to claim 4, characterized in that each middle shell comprises a printed circuit board carrying the second plug contacts and an opening for passage of cable wires.

6. The plug according to claim 5, further comprising a mandrel arranged on the base shell and engaging in an opening disposed in the printed circuit board, wherein a middle shell is mounted so as to allow a predetermined clearance between the printed circuit board and the base shell and the middle shell, respectively, for compensating vertical and horizontal tolerances at least one of the first and second plug contacts.

7. The plug according to claim 1, wherein each add-on module comprises a middle shell, and wherein the base shell, the middle shell or shells, and the cover are made of plastic.

8. The plug according to claim 2, wherein the retaining springs are incorporated in a geometry and a material of the base shell and the middle shell or shells.

9. The plug according to claim 1, wherein each add-on module comprises a middle shell, wherein an outer contour of the base shell, the middle shell or shells and the cover comprises a rectangular spring for absorbing tensile forces of a completely inserted system, wherein a corresponding groove is arranged in a rail connected to a mating connector.

10. The plug according to claim 1, wherein each add-on module comprises a middle shell, and wherein a handle-shaped extension is provided on an outer contour of the base shell, the middle shell or shells, and cover for handling the plug.

11. The plug according to claim 1, wherein the base shell comprises a recess disposed in a region of a seat for the printed circuit board, wherein the seat is configured to receive an ID-chip arranged on the printed circuit board.

* * * * *